US007261385B2

(12) United States Patent
Weinberger

(10) Patent No.: US 7,261,385 B2
(45) Date of Patent: Aug. 28, 2007

(54) PROTECTED CABINET

(76) Inventor: Yoav Weinberger, Hankin Street 53, Ramot Remez, Haifa 32762 (IL)

( * ) Notice: Subject to any disclaimer, the term of this patent is extended or adjusted under 35 U.S.C. 154(b) by 0 days.

(21) Appl. No.: 10/499,325

(22) PCT Filed: Oct. 2, 2002

(86) PCT No.: PCT/IL02/00802

§ 371 (c)(1),
(2), (4) Date: Jun. 17, 2004

(87) PCT Pub. No.: WO03/056890

PCT Pub. Date: Jul. 10, 2003

(65) Prior Publication Data

US 2005/0017607 A1 Jan. 27, 2005

(30) Foreign Application Priority Data

Dec. 26, 2001 (IL) ..... 147324
Feb. 5, 2002 (IL) ..... 148005

(51) Int. Cl.
*A47B 88/04* (2006.01)

(52) U.S. Cl. ..... 312/330.1; 312/333; 312/298

(58) Field of Classification Search ..... 312/330.1, 312/333, 204, 334.44, 257.1, 215, 298, 308; 70/85, 87; 235/7 R; 109/53, 54
See application file for complete search history.

(56) References Cited

U.S. PATENT DOCUMENTS

| | | | | |
|---|---|---|---|---|
| 128,439 | A * | 6/1872 | Unna | 312/204 |
| 1,061,646 | A * | 5/1913 | Welliver | 312/301 |
| 1,926,809 | A | 9/1933 | Jacobson | |
| 2,711,944 | A * | 6/1955 | Meek et al. | 312/333 |
| 3,243,247 | A * | 3/1966 | Knape | 312/333 |
| 3,332,729 | A | 7/1967 | Dickson | |
| 4,035,792 | A | 7/1977 | Price et al. | |
| 4,285,559 | A * | 8/1981 | Koch | 312/298 |
| 4,366,997 | A | 1/1983 | Lopez et al. | |
| 4,615,095 | A | 10/1986 | Bessinger et al. | |
| 4,803,346 | A * | 2/1989 | Lyons et al. | 235/7 R |
| 4,838,626 | A | 6/1989 | Parr | |
| 5,044,059 | A * | 9/1991 | De Giulio | 29/401.1 |
| 6,390,361 | B1 | 5/2002 | Gund | |

FOREIGN PATENT DOCUMENTS

| | | |
|---|---|---|
| DE | 3723316 | * 10/1988 |
| EP | 630509 | 3/1996 |
| FR | 2535573 | 5/1984 |
| FR | 2 618 993 | 2/1989 |
| JP | 04-236694 | 8/1992 |
| JP | 2000-105873 | 4/2000 |

OTHER PUBLICATIONS

Supplementary European Search Report for EP 02 77 5181 mailed Mar. 9, 2006.

* cited by examiner

*Primary Examiner*—James O. Hansen
(74) *Attorney, Agent, or Firm*—Pearl Cohen Zedek Latzer, LLP

(57) ABSTRACT

A protected cabinet for cash or other valuables, designed to protect the cash or valuables from being robbed, the protected cabinet comprising: a housing, for receiving and housing two drawers, having a front opening through which one or both drawers simultaneously may be withdrawn; a first drawer, adapted to be moved into and out of the housing through the front opening, coupled to a front panel, the front panel adapted to substantially cover the front opening of the housing; a second drawer, positioned over the first drawer, adapted to be moved into and out of the housing through the front opening, when engaged to the first drawer, substantially covering the first drawer when engaged to it, preventing view of contents of the first drawer; engagement mechanism for engaging the second drawer to the first drawer, whereby one drawer is regularly used for transactions or presentation of the cash or valuables kept in it, whereas the other drawer is used as an emergency, decoy, drawer, pulled open in emergency instances, such as in a robbery, by operating the engagement mechanism.

17 Claims, 9 Drawing Sheets

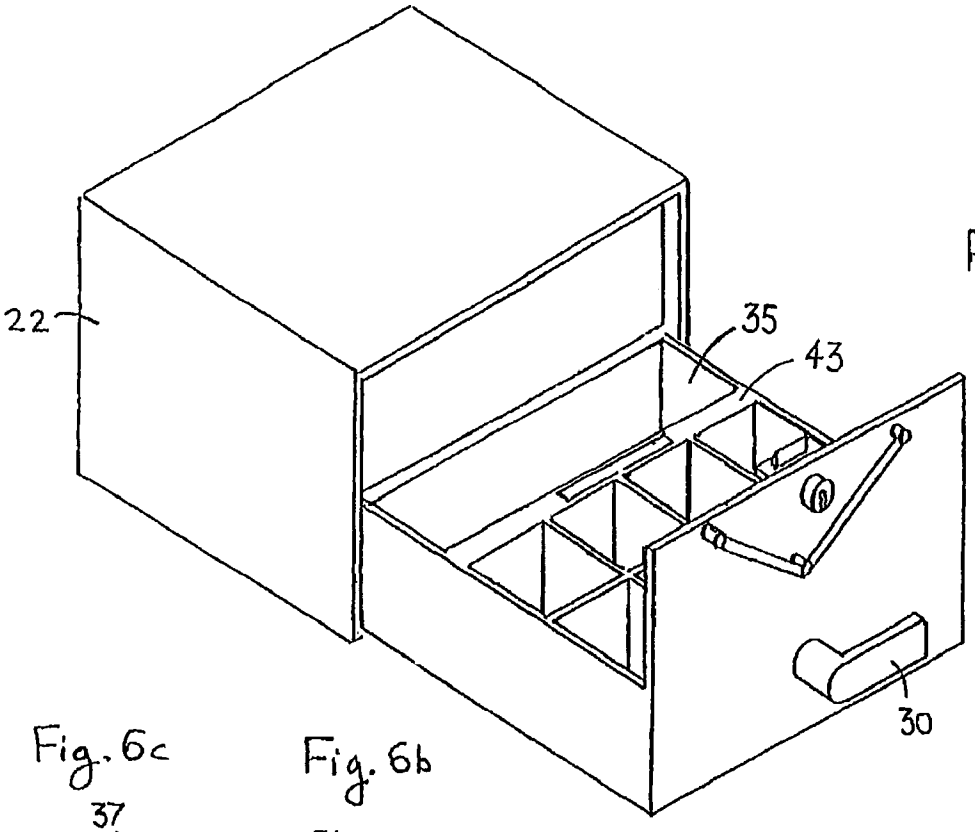
Fig. 5
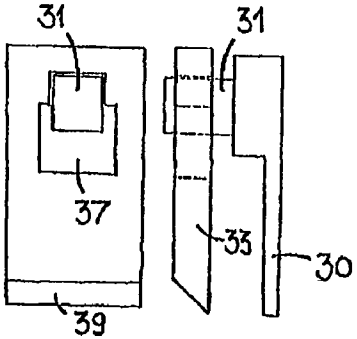
Fig. 6a
Fig. 6b
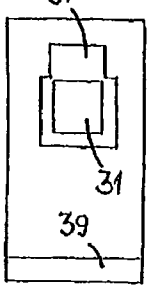
Fig. 6c
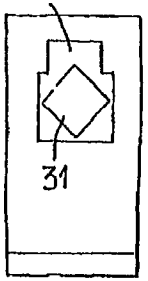
Fig. 6d

PROTECTED CABINET

CROSS-REFERENCE TO RELATED APPLICATIONS

This application is a National Phase Application of PCT International Application No. PCT/IL02/00802, International Filing Date Oct. 2, 2002, claiming priority of Israel Patent Applications, 147324, filed Dec. 26, 2001, and 148005, filed Feb. 5, 2002.

FIELD OF THE INVENTION

The present invention relates to protection from robbery or theft. More particularly, the present invention relates to a protected cabinet for cash or other items of value.

BACKGROUND OF THE INVENTION

Various methods of protection against robberies were developed over the years. Some of these methods include, forced delays before a safe door can be opened, doors locking when an emergency button is hit, silent alarm button, hidden beneath the desk, actuated to notify the police a robbery is in progress, etc.

Most of these methods impose obstructions on the robbers, and thus may cause the robbers to panic, or enrage them, leading to unnecessary violence or even casualties.

Often, In bank robberies, a robber enters a bank during working hours, finding the cashier sitting in front of an open cash drawer, and forces the cashier, at gun point, to hand over all the money found in that exposed drawer.

Methods and devices limiting the robber's access to his desired catch—money found in teller cabinets or safes, is dangerous, for the frustrated robber may take out his frustration on bank employees or customers. This notion has lead to the introduction of hidden drawers.

In U.S. Pat. No. 4,366,997 (Lopez et al.), titled HIDDEN DRAWER ARRANGEMENT FOR BANK TELLER CABINET, there was disclosed a hidden drawer arrangement for a cash transaction cabinet. A drawer is mounted in slide-out fashion in a compartment of a cabinet. A plain face panel on the drawer extends the width of the compartment to have the appearance of an immobile structural element of the cabinet. A latch arrangement is provided on the bottom of the drawer and is hidden by a lower section of the drawer face panel extending below the plane of the drawer bottom.

U.S. Pat. No. 4,035,792 (Price et al.), titled CASH REGISTER SECURITY SYSTEM, disclosed a cash register security system having a first latch normally adapted to engage and securely hold within a cash register a false drawer, a release device connected to the first latch for releasing the first latch from engaging and holding the false drawer within the cash register, a second latch adapted to engage and hold within the cash register a cash drawer, the second latch normally being in disengagement with the cash drawer, a locking device connected to the second latch for locking the second latch in engagement with the cash drawer and holding the cash drawer within the cash register, an alarm circuit connected to the release device and the locking device and an alarm switch connected to the alarm circuit for operating the alarm circuit and activating the release device and the locking device whereby the cash drawer is locked within the cash register and only the false drawer may be ejected from the cash register after the alarm switch is operated. A police silent alarm, a plurality of cameras and a flashing beacon also are connected to and operated by the alarm switch. This patent does not describe the physical properties of the drawer chest, but rather discloses an electronic scheme.

In FR Pat. 2535573 (Diemert et al.) there was disclosed a hidden drawer that normally nests within the drawer cabinet, and upon engagement using a hidden a cable, the hidden drawer is revealed, allowing access to its content.

U.S. Pat. No. 6,390,361 (Gund) disclosed a method of protecting an active cash drawer from robbery comprising the following steps: housing the active cash drawer together with an emergency cash drawer in a housing having a frontal opening to accommodate the opening of a cash drawer; arranging for the active cash drawer to open through the frontal opening in the housing to facilitate routine cash transactions; generating an alarm signal in the event of a robbery and arranging for the emergency cash drawer to open instead of the active cash drawer subsequent to the alarm signal. In a preferred embodiment of the invention the frontal opening is generally the height of a cash drawer and the cash drawers vertically shift upwards within the housing subsequent to the alarm signal so that the active cash drawer is aligned behind the frontal opening prior to the alarm signal and the emergency cash drawer is in alignment with the frontal opening subsequent thereto.

Diemert and Lopez both deal with a hidden drawer arrangement, that can be used for concealing valuables etc., so that the latter may be saved, but the hidden drawer merely provides a concealed space for use. Price and Gund describe decoy drawers containing little sums of money, that are to be opened during robbery, aimed at fooling the robber to think the decoy drawer is the real operating drawer, and thus settle for the money found there, believing no more money can be stolen.

It is the purpose of the present invention to provide a novel protected cabinet for bank tellers or the like, having a normally operated drawer that would contain the sums of money required for the normal operation of the teller, and a decoy drawer that in the event of a robbery substitutes the normal drawer, leading the robber to believe the decoy drawer is in fact the normal drawer, and thus make do with what is found in it Other advantages and objects of the present invention will be appreciated after reading the present specification and viewing the accompanying drawings.

SUMMARY OF THE INVENTION

There is thus provided, in accordance with a preferred embodiment of the present invention, a protected cabinet for cash or other valuables, designed to protect the cash or valuables from being robbed, the protected cabinet comprising:

a housing, for receiving and housing two drawers, having a front opening through which one or both drawers simultaneously may be withdrawn;

a second drawer, positioned over the first drawer, adapted to be moved into and out of the housing through the front opening, when engaged to the first drawer, completely covering a top face of the first drawer when engaged to it, preventing view of contents of the first drawer; and an engagement mechanism having an external actuation knob for engaging the second drawer to the first drawer and said first and second drawers to the front panel, the engagement mechanism being operable only when both drawers are fully inside the housing with the front panel covering the front opening.

engagement mechanism for engaging the second drawer to the first drawer, whereby one drawer is regularly used for transactions or presentation of the cash or valuables kept in it, whereas the other drawer is used as an emergency, decoy, drawer, pulled open in emergency instances, such as in a robbery, by operating the engagement mechanism.

Furthermore, in accordance with a preferred embodiment of the present invention, the drawers are provided with partitions, dividing the drawers into compartments.

Furthermore, in accordance with a preferred embodiment of the present invention, the front panel is provided with a handle.

Furthermore, in accordance with a preferred embodiment of the present invention, a key lock is provided in order to allow opening of the drawers only when using a key.

Furthermore, in accordance with a preferred embodiment of the present invention, the first drawer has a back portion normally hidden within the housing, and provided with a latching mechanism that in a first state prevents fully withdrawing the first drawer, keeping the hidden portion inside the housing, and in a second state releases the hidden portion to be withdrawn and exposed out of the housing.

Furthermore, in accordance with a preferred embodiment of the present invention, the latching mechanism comprising a lever pivotally connected to a partition defining the hidden portion, the lever coupled to an arm having a wedge, so that when the lever is pressed the wedge is lifted over a ligule provided at the bottom of the housing 22, making the withdrawal and exposure of the hidden compartment possible.

Furthermore, in accordance with a preferred embodiment of the present invention, second drawer is prevented from opening when the first drawer is opened, by means of a stopper mechanism.

Furthermore, in accordance with a preferred embodiment of the present invention, the stopper mechanism comprises a lever pivotally coupled to the second drawer at a pivot, the lever having a ligule that may be inserted into a recess in a partition between the first drawer and the second drawer, an end of the lever limited by a stopper protruding inwardly from the housing, and wherein the stopper mechanism is operated to free the second drawer by a latch inserted through the recess, lifting the lever over the stopper.

Furthermore, in accordance with a preferred embodiment of the present invention, the engagement mechanism comprises a latch coupled to the first drawer actuated by a knob provided on the drawer front panel, whereby when the latch is extended it engages into a recess provided in the second drawer, causing the second drawer to be opened when the drawer front panel is pulled, and when it is retracted, it leaves the recess, disengaging the second drawer.

Furthermore, in accordance with a preferred embodiment of the present invention, the operation of the knob is limited by a limiting mechanism so that engaging the second drawer is possible only when the first drawer is retracted into the housing and the drawer front panel covers the opening of the housing.

Furthermore, in accordance with a preferred embodiment of the present invention, the limiting mechanism comprises a bar having a bore through which an axle having a polygonal cross section, coupled to the knob passes, the bore shaped in such a way that an upper portion of the bore matches the polygonal cross section of the axle, and a lower portion substantially larger so as to allow the axle to turn inside, and suspended from the axle, thus preventing turning of the axle, the bar extended to a length slightly longer than required to reach the bottom of the housing, so that when the front panel is pushed to cover the opening the bar is lifted freeing the axle to turn.

Furthermore, in accordance with a preferred embodiment of the present invention, the housing is provided with an inclination so that the first drawer is automatically retracted to a closed state, when not held manually Furthermore, in accordance with a preferred embodiment of the present invention, a stopper for stopping the retraction of the first drawer caused by the inclination, and leaving the first drawer open for as long as the stopper is used.

Furthermore, in accordance with a preferred embodiment of the present invention, the stopper comprises a plate pivotally attached to the housing coupled to a foot passing through the housing facing the first drawer, so that when the plate is pressed towards the housing the drawer is kept in place.

Finally, in accordance with a preferred embodiment of the present invention, a spring is provided in order to remove the foot away from the first drawer when the plate is not pressed.

BRIEF DESCRIPTION OF THE DRAWINGS

In order to better understand the present invention and appreciate its practical applications, the following Figures are provided and referenced hereafter. It should be noted that the Figures are given as examples only and in no way limit the scope of the invention. Like components are denoted by like reference numerals.

FIG. 5 illustrates a view of the protected cabinet of FIG. 1, with the regular drawer in a fully opened state.

FIGS. 6*a*, 6*b*, 6*c* and 6*d* illustrate various stages of operation of a security mechanism limiting the operation of the drawer knob.

DETAILED DESCRIPTION OF PREFERRED EMBODIMENTS

The protected cabinet of the present invention is aimed at providing a secured cabinet for cash and other valuables, for use by a public service provider, such as a bank teller (hereinafter referred to as "a teller").

An aspect of the present invention is the provision of a regular drawer and an emergency drawer in the cabinet. Under regular circumstances, the regular drawer is used by the teller for transactions carried our during then regular course of business. When an emergency situation, namely a robbery, occurs, the teller switches to the emergency drawer, that contains some money and hands it to the robber to appease him, making him believe he got all the content of the cash drawer (the fact that there are two drawers in the cabinet is of course kept a as secret and not revealed to the public).

Another aspect of the present invention is the provision of such protected cabinet with safety means aimed at preventing opening of the emergency drawer when the regular drawer is opened, in order to avoid inadvertent exposure of the emergency drawer, or opening by a thief or robber that has already got hold of the contents of the regular drawer, and thus preventing soaring of the losses.

Another aspect of the present invention is the provision of a hidden compartment to the regular drawer, thus allowing safe disposal of cash or valuables in the regular drawer, hidden from the public, and especially from ill-intentioned persons.

Other aspects and advantages of the present invention will be appreciated after reading the present specification and reviewing the accompanying drawings.

Figure 1:
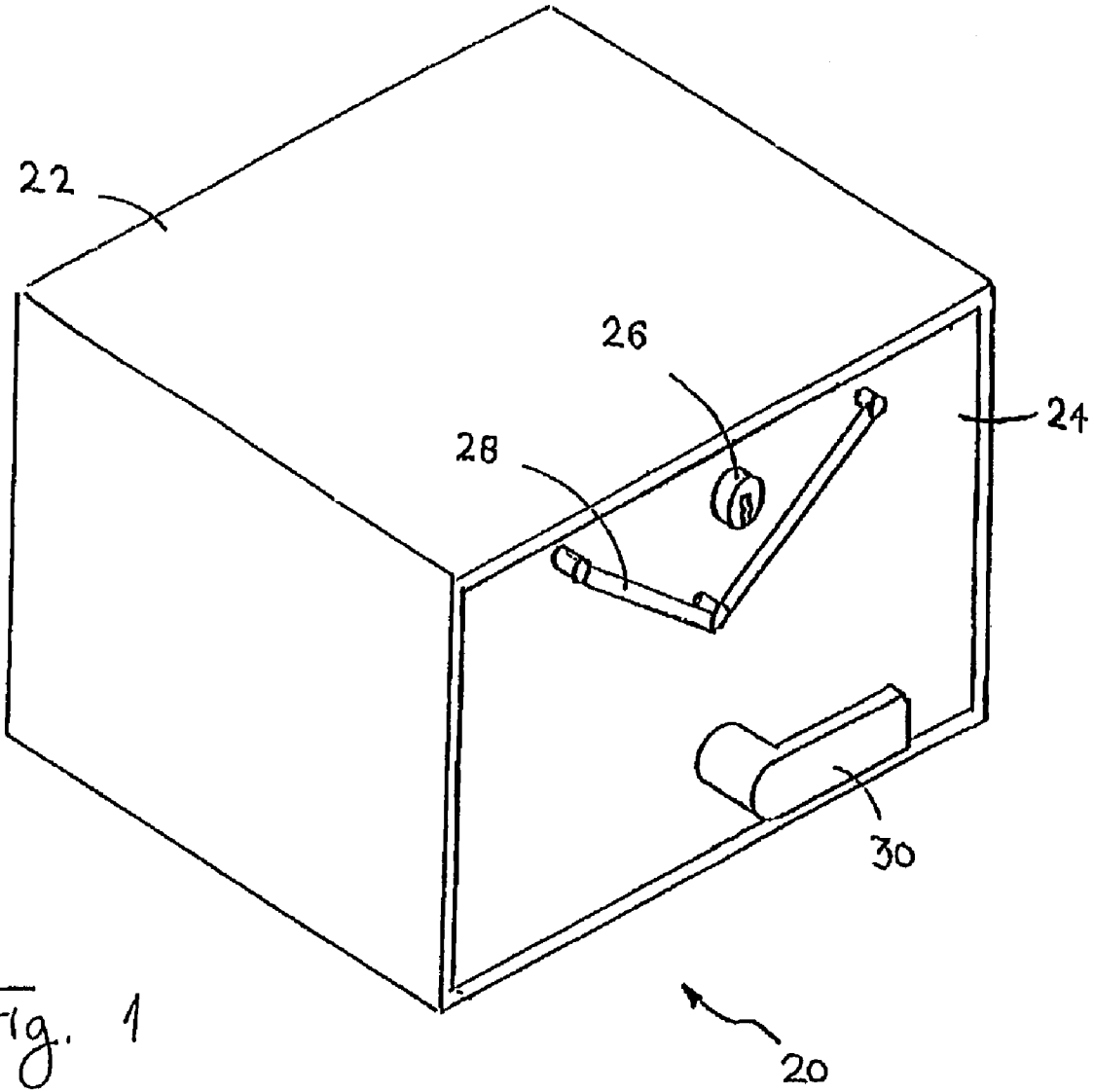
FIG. 1 illustrates a protected cabinet in accordance with a preferred embodiment of the present invention.

Reference is now made to FIG. 1, illustrating a protected cabinet in accordance with a preferred embodiment of the present invention. A drawer cabinet 20 comprises a housing 22, preferably made of steel or other rigid durable material, having a drawer front panel 24, on which operation knob 30, handle 28 and key lock 26 are provided. Inside the housing, behind the drawer front panel are provided two drawers (not shown in this Figure. See other Figs.), positioned one over the other. One drawer—the bottom drawer, in the drawer cabinet depicted in the drawings—is a drawer used regularly for storing cash or other valuables, being opened and closed by the teller in his usual course of action during his work according to his needs (hereinafter—the regular drawer), and the other drawer—the top drawer in the embodiment shown in the drawings—is an emergency drawer, to be used only in an emergency. The emergency drawer is provided as a decoy, aimed at being opened in the instance of robbery, making the robber believe this is in fact the regular drawer and thus limiting the loss to the predetermined sums of money or valuables that are placed there in advance (it is recommended that small amount of money is indeed placed in the emergency drawer, so that the robber faces to big a disappointment that might result in him becoming violent or enraged). Of course, in other embodiments of the present invention the drawers can be also placed the other way around—the regular drawer being the top drawer and the emergency drawer being the bottom one, and this arrangement is also covered by the present invention. Both drawers are preferably mounted on rails (not shown in the figure) allowing their motion in and out of the housing. The drawer front panel 24 substantially and effectively covers the opening of the housing, hiding both drawers behind it, and in fact does not provide any hint as to the existence of two drawers in the cabinet. It is desired to make the cabinet so that a person not familiar with its design will assume it contains only one drawer.

Figure 2:
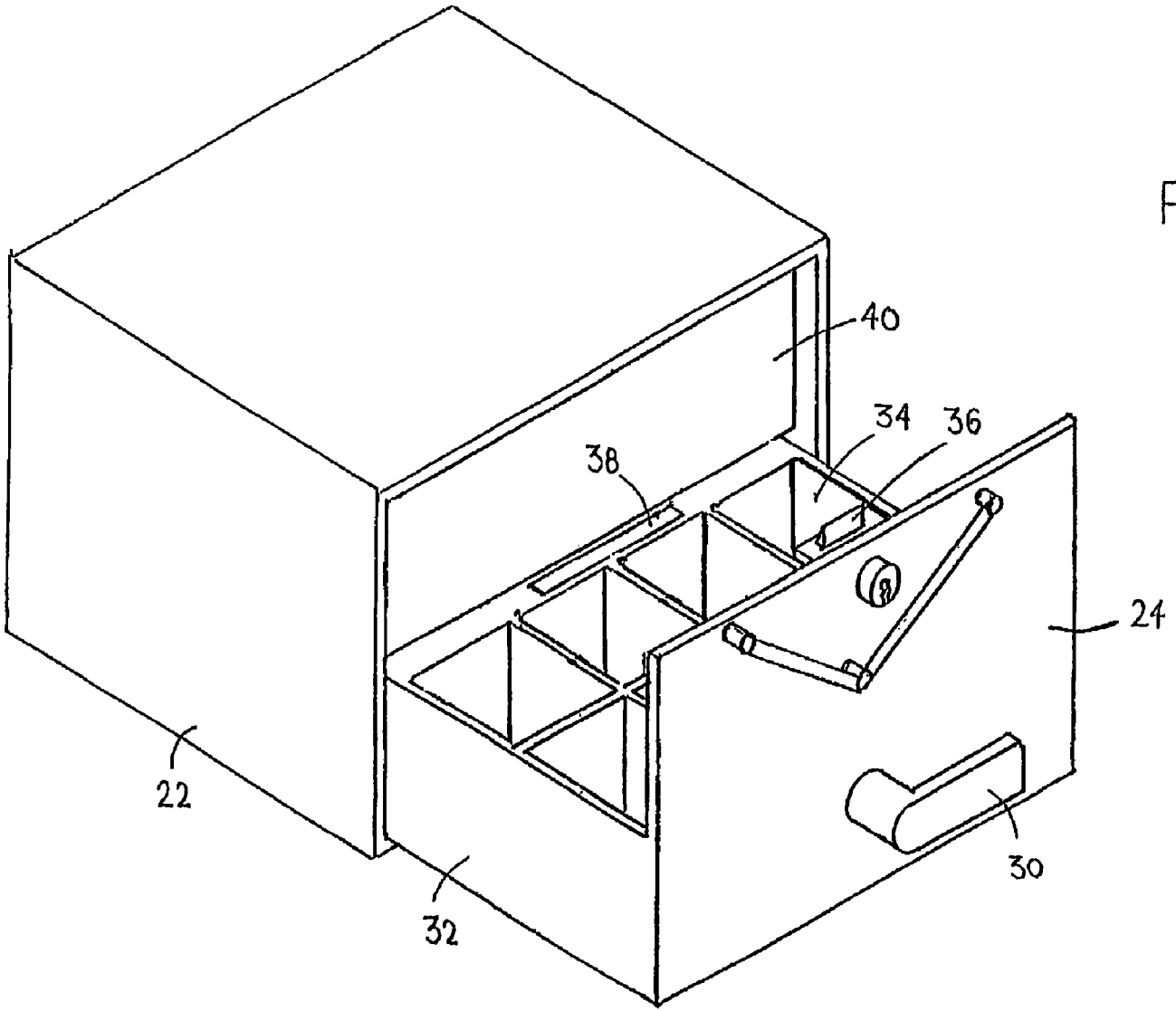
FIG. 2 illustrates the protected cabinet of FIG. 1 with the regular drawer in an opened state.

FIG. 2 illustrates the protected cabinet of FIG. 1 with the regular drawer in an opened state. The regular drawer preferably has several divisions within it, dividing the drawer into compartments 34 for keeping different values of bill notes or coins in them. The regular drawer has a hidden portion located at the back of the drawer, and is normally inside the housing, a latch mechanism, whose lever 38 is shown, preventing its inadvertent withdrawal and exposure (see also FIG. 3). Emergency drawer 40, has no markings, or handles or any other kind of indication suggesting it is a drawer, and its front wall appears to be an immobile part of the housing. As is explained hereinafter, the emergency drawer is preferably provided with a safety mechanism (see FIG. 10) preventing its opening, when the regular drawer is opened. This is important in order to avoid a situation where, in a robbery, the robber picks the contents of the regular drawer and in addition opens the emergency drawer and takes what money or valuables that are found there too.

Figure 3:
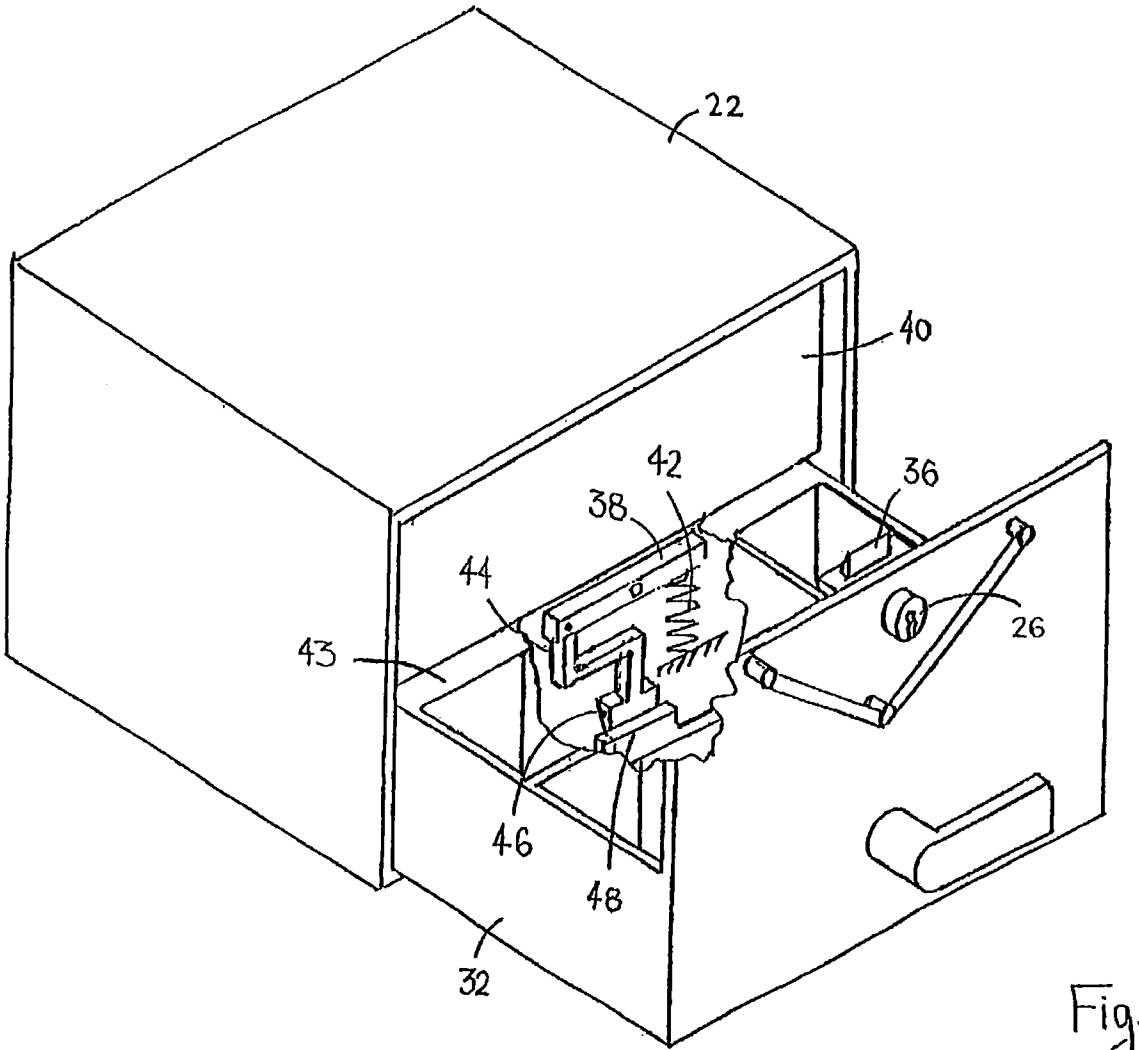
FIG. 3 illustrates the protected cabinet of FIG. 2 showing the latch mechanism of the hidden compartment.

FIG. 3 illustrates the protected cabinet of FIG. 2 showing the latch mechanism of the hidden compartment. Partition 43 divides the regular drawer into two main parts, the regularly accessed by the teller (seen exposed in FIG. 2), and a hidden part—the hidden compartment generally not accessed by the teller in the usual course of action. Lever 38 is pivotally connected to partition 43, so that when its end is pushed arm 44 is lifted withdrawing wedge 46 from ligule 48, provided at the bottom of the housing 22, making the withdrawal and exposure of the hidden compartment possible. Spring 42 is optionally provided, to counter pull lever 38 back to its engaged position, balancing the weight of arm 44. Latch 36 is preferably provided, operated by a key inserted in the key lock 26, with a matching recess provided in the top surface of the housing (not shown) so that the drawer cabinet may be opened only when using a key.

Figure 4A:
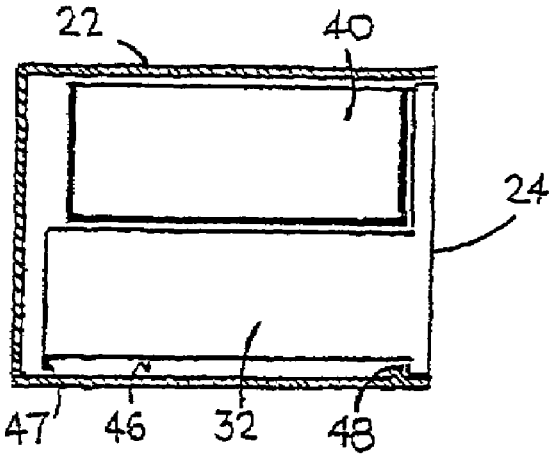
FIG. 4*a* illustrates a sectional side view of the protected cabinet of FIG. 1, with the regular and emergency drawers in the closed state.
Figure 4B:
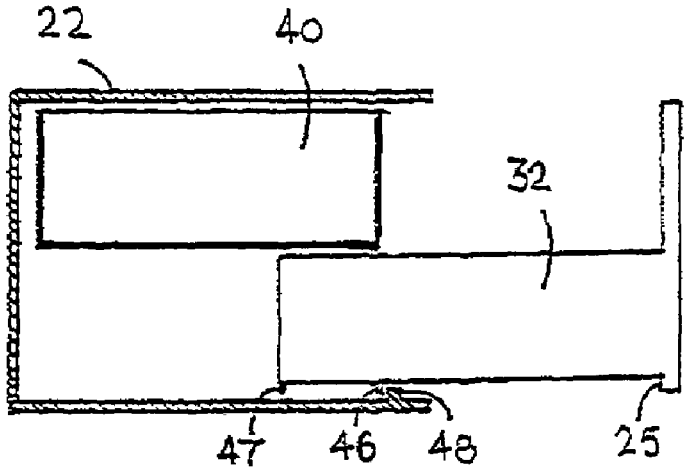
FIG. 4*b* illustrates a sectional side view of the protected cabinet of FIG. 1, with the regular drawer in an opened state.
Figure 4C:
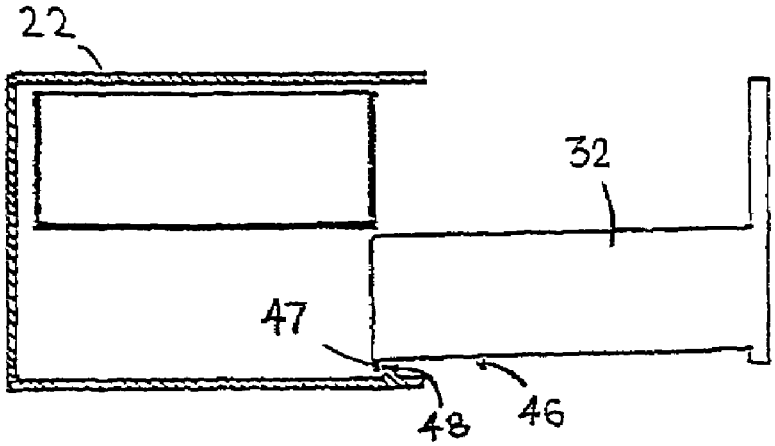
FIG. 4*c* illustrates a sectional side view of the protected cabinet of FIG. 1, with the regular drawer in a fully opened state (exposing the hidden compartment of the regular drawer).

FIG. 4*a* illustrates a sectional side view of the protected cabinet of FIG. 1, with the regular and emergency drawers in the closed state. FIG. 4*b* illustrates a sectional side view of the protected cabinet of FIG. 1, with the regular drawer in an opened state. FIG. 4*c* illustrates a sectional side view of the protected cabinet of FIG. 1, with the regular drawer in a fully opened state (exposing the hidden compartment of the regular drawer).

FIG. 5 illustrates a view of the protected cabinet of FIG. 1, with the regular drawer in a fully opened state, exposing the hidden compartment 35, and allowing the teller to access it.

When an emergency situation rises, namely a robbery takes place, the teller must immediately close the regular drawer, if it is not already closed, and operate knob 30 to engage the emergency drawer. Knob 30 preferably may be operated only when the drawers are closed, preventing any erroneous switching and consequent release of the wrong drawer.

FIGS. 6*a*, 6*b*, 6*c* and 6*d* illustrate various stages of operation of a security mechanism limiting the operation of drawer knob 30. Axle 31 of knob 30, which is coupled to the engagement mechanism of the emergency drawer (see FIGS. 8*a*–8*c*), is passed through a bore 37 in bar 33, suspended over the axle. Bore 37 has a rectangular shape at its upper end, matching the cross sectional shape of the axle, and a lower wider portion large enough to allow axle 31 to be turned freely when not enclosed by the upper rectangular portion. When bar 33 hangs freely on axle 31, axle 31 fits into the upper rectangular portion of the bore, and thus is limited from turning. The length of bar 33 is determined to be such that its lower end 39 extends beyond the lower surface of the housing. When the front panel is drawn inside and closed end 39 is raised by the lower surface of the housing, thus freeing axle 31 from the limiting rectangular portion, allowing the turning of knob 30. end 39 is preferably shaped as a wedge to ease its raising by the lower surface of the housing.

Figure 7:
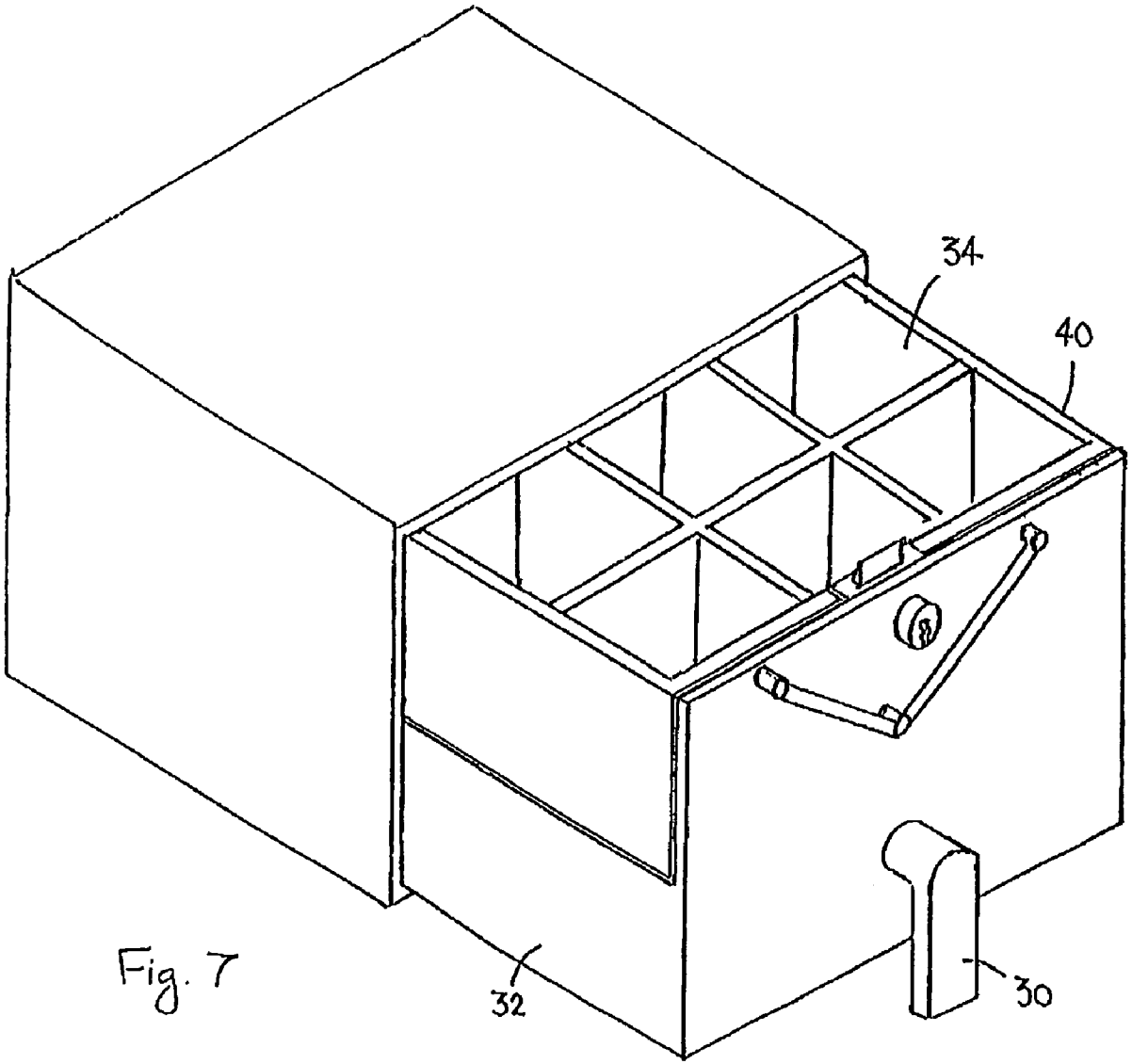
FIG. 7 illustrate a view of the protected cabinet of FIG. 1, with the emergency drawer in an open state.

FIG. 7 illustrate a view of the protected cabinet of FIG. 1, with the emergency drawer in an open state. When knob 30 is turned to engage the emergency drawer, the drawer is engaged to the regular drawer on top, and when the drawer front panel is pulled, the emergency drawer 40 (preferably divided into compartments 34) shows up, revealing its contents, and at the same time covering and concealing the regular drawer 32.

Figure 8C:
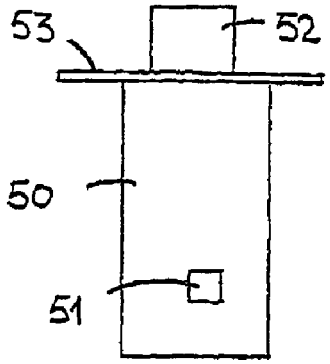
FIG. 8*c* illustrates the latch device used in the engagement mechanism of FIGS. 8*a*, 8*b*.
Figure 8A:
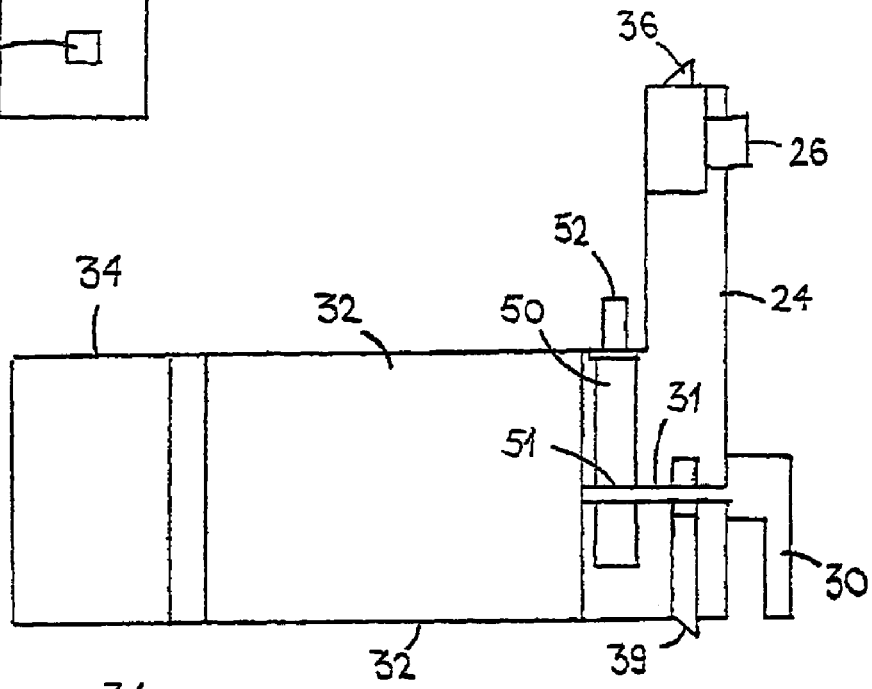
FIG. 8*a* illustrates a side sectional view of the engagement mechanism for engaging and disengaging the emergency drawer.
Figure 8B:
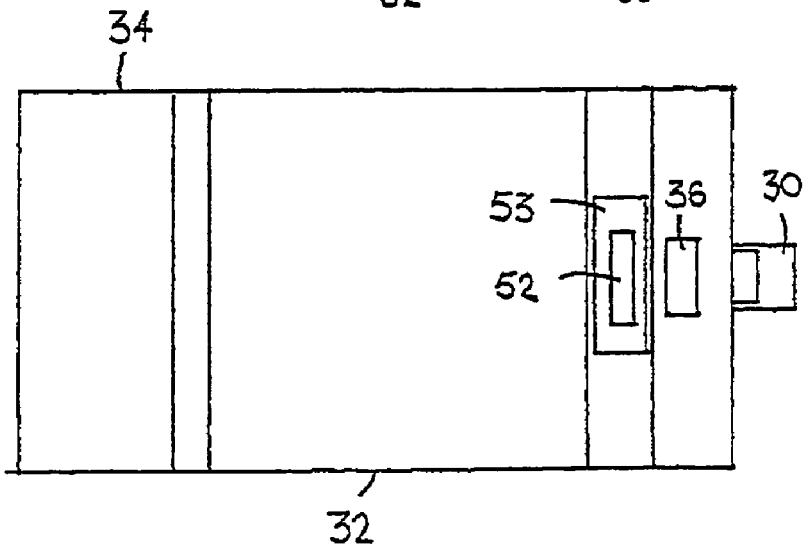
FIG. 8*b* illustrates a top view of the engagement mechanism for engaging and disengaging the emergency drawer.

FIG. 8*a* illustrates a side sectional view of the engagement mechanism for engaging and disengaging the emergency drawer. FIG. 8*b* illustrates a top view of the engagement mechanism for engaging and disengaging the emergency drawer. FIG. 8*c* illustrates the latch device used in the engagement mechanism of FIGS. 8*a*, 8*b*. The axle 31 coupled to knob 30 is used to actuate latch mechanism 50 (in the embodiment shown in the figure, a latch mechanism of the type used for doors is provided), the axle inserted in bore 51 of the latch mechanism 50. In the engaged mode latch 52 extends over face plate 53, inserted into a matching recess (see 63 in FIG. 10*b*) in the bottom of emergency drawer 40, whereas in the disengaged mode, the latch is retracted letting go of the emergency drawer. The end of the drawer is designated 47.

Figure 9A:
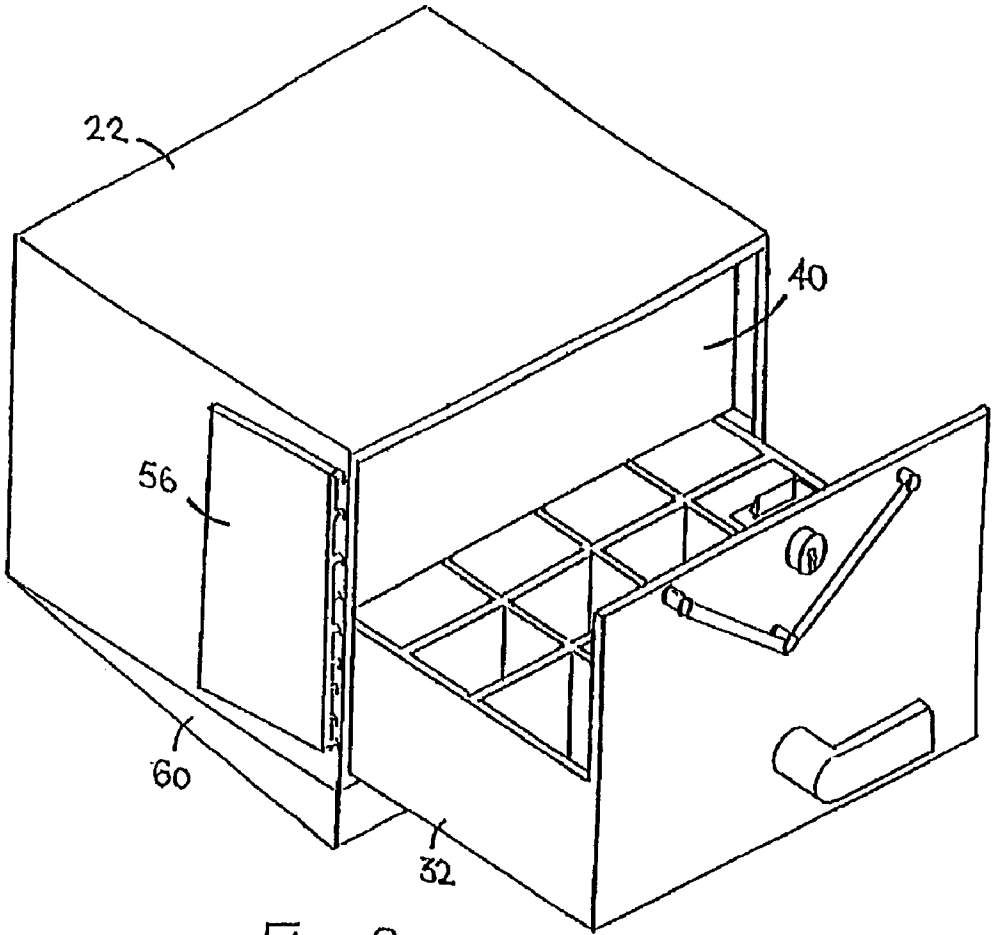
FIG. 9*a* illustrates a view of another preferred embodiment of the protected cabinet of the present invention, with the regular drawer in an opened state, provided with a stopper and an inclination.
Figure 9B:
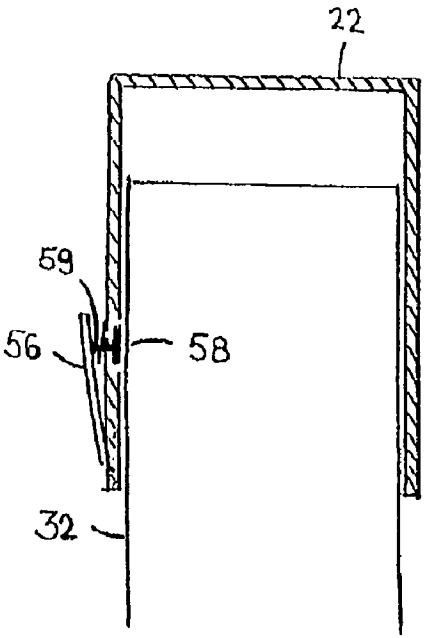
FIG. 9*b* illustrates a top sectional view of the protected cabinet of FIG. 9*a*, showing the operation of the stopper.

FIG. 9*a* illustrates a view of another preferred embodiment of the protected cabinet of the present invention, with the regular drawer in an opened state, provided with a stopper and an inclination 60. This is aimed at forcing the regular drawer to close, each time the teller releases his hold of the drawer. The default state of the drawer, as a result of this inclination, is closed. This way, the teller is less likely to be caught with the regular drawer open when a robber steps into the bank: and in any case; once the drawer is freed it shuts. Thus if the situation requires switching to the emergency drawer all the teller needs to do is turn the knob to the emergency mode, and when the drawer front panel is pulled the emergency drawer emerges. However, the teller might need, in the regular course of business, to free his hands and still hold the regular drawer opened. For this a stopper 56 is provided. FIG. 9*b* illustrates a top sectional view of the protected cabinet of FIG. 9*a*, showing the operation of the stopper. The stopper, here in the form of a plate, is pivotally attached to housing 22. Foot 58, coupled to the plate is provided, passing through housing 22 facing the regular drawer, so that when the stopper plate is pressed towards the housing (the teller can use his thigh to do so), the drawer is kept in place, preventing its gliding back to the closed position. When the teller releases the stopper, the foot is resiliently retracted (by spring 59), and the drawer if freed to close.

Figure 10B:
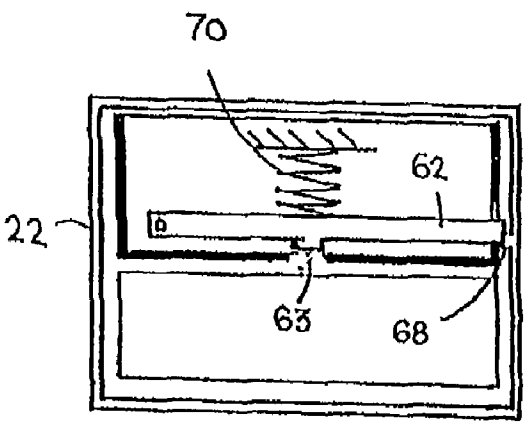
FIGS. 10*a* and 10*b* show a see-through view of a stopper mechanism for preventing opening of the emergency drawer when the regular drawer is in an opened state.
Figure 10A:
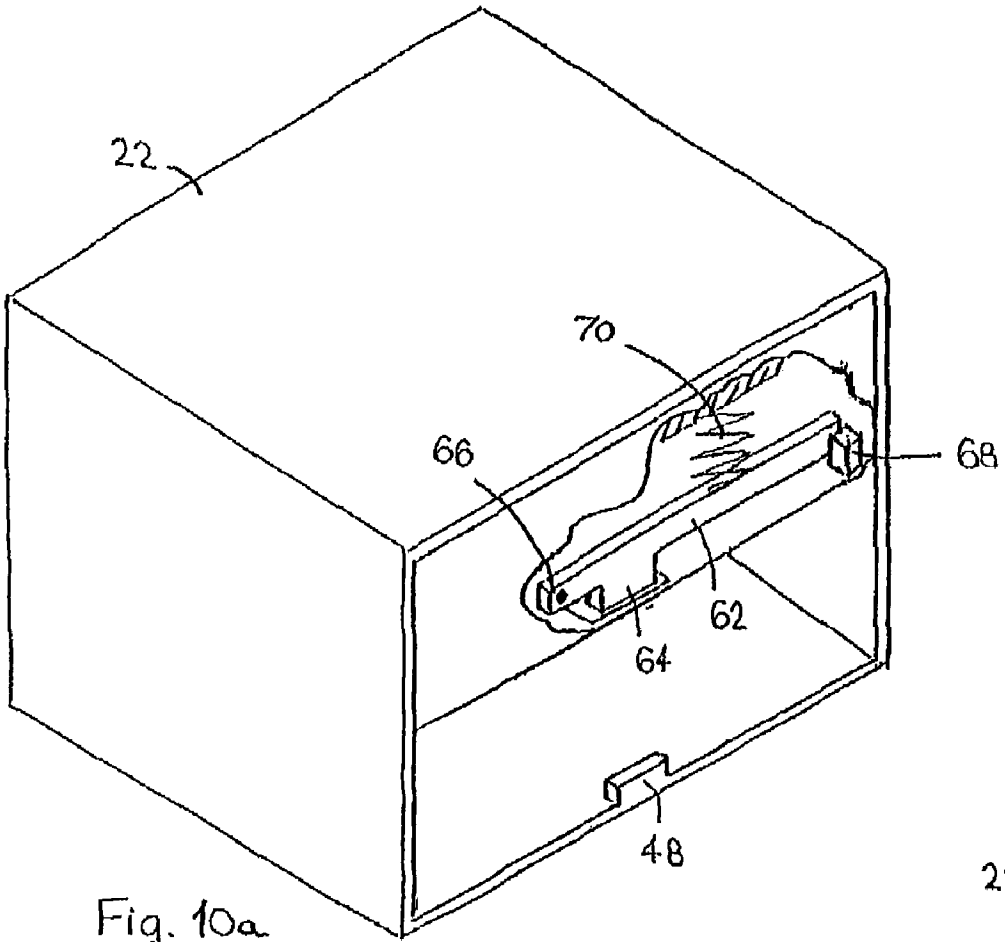

FIGS. 10*a* and 10*b* show a see-through view of a stopper mechanism for preventing opening of the emergency drawer when the regular drawer is in an opened state. The stopper mechanism comprises a lever 62 pivotally coupled to the emergency drawer 40 (at the front wall) at pivot 66 with a ligule 64 that may be inserted in recess 63, the other end of the lever limited by stopper 68 protruding inwardly from housing 22. When the drawer front panel is fully retracted—i.e. the drawers are closed, knob 30 may be turned to engage the emergency drawer (see FIG. 8*b*), and latch 52 when inserted into recess 63 pushes away ligule 64, lifting lever 62 over stopper 68, and releasing the emergency drawer to be pulled open.

It is noted that all means of engagement, locking and holding shown in the embodiments depicted in the figures accompanying this specification serve to explain the present invention, and in no way limit the scope of it. Other alternative such means may be employed by a person skilled in the art and would still be covered by the present invention. It is also noted that the engagement mechanism for the engagement of the emergency drawer can alternatively be replaced by a lock mechanism operated by a key. However, the inventor of the present invention recommends using a knob to render the protected cabinet a more authentic look, and prevent any suspicion raised by a robber who might be puzzled by the presence of two keys.

The protected cabinet of the present invention can incorporate other protection means such as an alarm system, either loud sounding siren, or silent (signaling an emergency signal at a near by police station). The latter is preferred, as it is an aim of the present invention to prevent risky situation where the robber might loose his temper and act irrationally.

It should be clear that the description of the embodiments and attached Figures set forth in this specification serves only for a better understanding of the invention, without limiting its scope as covered by the following claims.

It should also be clear that a person skilled in the art, after reading the present specification could make adjustments or amendments to the attached Figures and above described embodiments that would still be covered by the following claims.

The invention claimed is:

1. A protected cabinet for cash or other valuables, designed to protect the cash or valuables from being robbed, the protected cabinet comprising:

a housing, for receiving and housing two drawers, having a front opening through which one or bath drawers simultaneously may be withdrawn;

a first drawer, adaptcd to be moved into and out of the housing through the front opening, coupled to a front panel, the front panel adapted to substantially cover the front opening of the housing;

a second drawer, positioned over the first drawer, adapted to be moved into and out of the housing through the front opening, when engaged to the first drawer, completely covering a top face of the first drawer when engaged to it, preventing view of contents of the first drawer; and an engagement mechanism having an external actuation knob for engaging the second drawer to the first drawer and said first and second drawers to the front panel, the engagement mechanism being operable only when both drawers are fully inside the housing with the front panel covering the front opening.

2. The protected cabinet as claimed in claim 1, wherein the drawers arc provided with partitions, dividing the drawers into compartments.

3. The protected cabinet as claimed in claim 1. wherein the front panel is provided with a handle.

4. The protected cabinet as claimed in claim 1, wherein a key lock is provided in order to allow opening of the drawers only when using a key.

5. The protected cabinet as claimed in claim 1, wherein the first drawer has a back portion normally hidden within the housing, and provided with a latching mechanism that in a first state prevents fully withdrawing the first drawer, keeping the hidden portion inside the housing, and in a second state releases the hidden portion to be withdrawn and exposed out of the housing.

6. The protected cabinet as claimed in claim 5, wherein the latching mechanism comprises a lever pivatally connected to a partidon defining the hidden portion, the lever coupled to an arm having a wedge, so that when the lever is pressed the wedge is lifted over a ligule provided at the bottom of the housing, making the withdrawal and exposure of the hidden compartment possible.

7. The protected cabinet as claimed in claim 1, wherein the second drawer is prevented from opening when the first drawer is opened, by means of a stopper mechanism.

8. The protected cabinet as claimed in claim 7, wherein the stopper mechanism comprises a lever pivotally coupled to the second drawer at a pivot, the lever having a ligule that may be inserted into a recess in the second drawer, an end of the lever limited by a stopper protruding inwardly from the housing, and wherein the stopper mechanism is operated to free the second drawer by a latch inserted through the recess, lifting the lever over the stopper.

9. The protected cabinet as claimed in claim 1, wherein the engagement mechanism comprises a latch coupled to the first drawer actuated by the actuation knob, whereby when the latch is extended it engages into a recess provided at the bottom of the second drawer, causing the second drawer to be opened when the drawer front panel is pulled, and when it is retracted, it leaves the recess, disengaging the second drawer.

10. The protected cabinet as claimed in claim 9, wherein the operation of the knob is limited by a limiting mechanism so that engaging the second drawer is possible only when the first drawer is retracted into the housing and the drawer front panel covers the opening of the housing.

11. The protected cabinet as claimed in claim 10, wherein the limiting mechanism comprises a bar having a bore through which an axle having a polygonal cross section, coupled to the knob passes, the bore shaped in such a way that an upper portion of the bore matches the polygonal cross section of the axle, and a lower portion substantially larger so as to allow the axle to turn inside, and suspended From the axle, thus preventing tuning of the axle, the bar extended to a length slightly longer than required to reach the bottom of the housing, so that when the front panel is pushed to cover the opening the bar is lifted freeing the axle to turn.

12. The protected cabinet as claimed in claim 1, wherein the housing is provided with an inclination so that the first drawer is automatically retracted to a closed state, when not held manually.

13. The protected cabinet as claimed in claim 12, wherein a stopper for stopping the retraction of the first drawer caused by the inclination, and leaving the first drawer open for as long as the stopper is used.

14. The protected cabinet as claimed in claim 13, wherein the stopper comprises a plate pivotally attached to the housing coupled to a foot passing through the housing facing the first drawer, so that when the plate is pressed towards the housing the drawer is kept in place.

15. the protected cabinet as claimed in claim 14, wherein a spring is provided in order to remove the foot away from the first drawer when the plate is not pressed.

16. The protected cabinet as claimed in claim 1, further comprising a safety mechanism preventing said second drawer from opening when said second drawer is not engaged to said first drawer.

17. The protected cabinet as claimed in claim 1, further comprising a limiting mechanism permitting said second drawer to be engaged to said first drawer only when said first drawer is retracted into the housing and the drawer front panel covers the opening of the housing.

* * * * *